US006634203B1

(12) United States Patent
Ras

(10) Patent No.: US 6,634,203 B1
(45) Date of Patent: Oct. 21, 2003

(54) PROCESS FOR THE PRODUCTION OF A CAN BY WALL IRONING

(75) Inventor: Hendrik Bastiaan Ras, Heemskerk (NL)

(73) Assignee: Corus Staal BV, CA IJmuiden (NL)

( * ) Notice: Subject to any disclaimer, the term of this patent is extended or adjusted under 35 U.S.C. 154(b) by 0 days.

(21) Appl. No.: 09/623,027

(22) PCT Filed: Feb. 18, 1999

(86) PCT No.: PCT/EP99/01010

§ 371 (c)(1),
(2), (4) Date: Sep. 19, 2000

(87) PCT Pub. No.: WO99/44766

PCT Pub. Date: Sep. 10, 1999

(30) Foreign Application Priority Data

Mar. 4, 1998 (NL) ..... 1008468

(51) Int. Cl.[7] ..... B21D 22/20

(52) U.S. Cl. ..... 72/349; 72/347; 413/69; 413/70

(58) Field of Search ..... 413/70, 69; 72/347, 72/349

(56) References Cited

U.S. PATENT DOCUMENTS

| | | | | | |
|---|---|---|---|---|---|
| 3,655,349 | A | | 4/1972 | Shah et al. | |
| 3,765,206 | A | | 10/1973 | Shah et al. | |
| RE28,511 | E | * | 8/1975 | Avitzur | 72/347 |
| 3,942,351 | A | * | 3/1976 | Avitzur | 72/271 |
| 4,040,282 | A | * | 8/1977 | Saunders | 72/41 |
| 4,442,692 | A | * | 4/1984 | Lyu | 72/349 |
| 4,732,031 | A | * | 3/1988 | Bulso et al. | 72/363 |
| 4,779,442 | A | * | 10/1988 | Welsh | 72/347 |
| 4,881,394 | A | * | 11/1989 | Jansen | 72/45 |
| 5,168,742 | A | * | 12/1992 | Heyes et al. | 72/379.4 |
| 5,238,715 | A | * | 8/1993 | Wefers et al. | 428/34.4 |
| 5,487,295 | A | * | 1/1996 | Diekhoff et al. | 72/379.4 |
| 5,742,993 | A | * | 4/1998 | Sun | 29/527.5 |
| 5,782,375 | A | * | 7/1998 | McHenry et al. | 220/62.12 |
| 5,787,752 | A | * | 8/1998 | Iwase et al. | 72/349 |
| 5,950,468 | A | * | 9/1999 | Shimizu et al. | 72/41 |

FOREIGN PATENT DOCUMENTS

| | | |
|---|---|---|
| EP | 0298560 | 1/1989 |
| EP | 0402006 | 12/1990 |
| FR | 2102173 | 4/1972 |
| GB | 2181082 | 4/1987 |
| WO | 9101830 | 2/1991 |
| WO | 9515226 | 6/1995 |

* cited by examiner

*Primary Examiner*—William Hong
(74) *Attorney, Agent, or Firm*—Stevens, Davis, Miller & Mosher, LLP

(57) ABSTRACT

A process for the production of a can comprising a base and a tubular body from sheet metal which is coated on at least one side with a layer of plastic, in which process, firstly, a round disc is produced from the sheet metal, which disc is then deep-drawn into a cup which is coated at least on the outside with the layer of plastic, after which this cup is formed into a can by wall ironing, the wall ironing taking place in a single stroke by moving the cup successively through a plurality of wall-ironing rings, in which process an optionally metal-coated steel sheet is used as the sheet metal, and in which process the entry angle from each of the successive at lest three wall-ironing rings is smaller than that of the preceding ring.

15 Claims, 2 Drawing Sheets

PROCESS FOR THE PRODUCTION OF A CAN BY WALL IRONING

FIELD OF THE INVENTION

The invention relates to a process for the production of a can comprising a base and a tubular body from sheet metal which is coated on at least one side with a layer of plastic, in which process, firstly, a round disc is produced from the sheet metal, which disc is then deep-drawn into a cup which is coated at least on the outside with the layer of plastic, after which this cup is formed into a can by wall ironing, the wall ironing taking place in a single stroke by moving the cup successively through a plurality of wall-ironing rings. A process of this nature is described in European Patent No. 0,402,006 B1, which is based on a laminate comprising an aluminium sheet. This patent proposes that the problems with processing of this laminate be solved by employing a combination of a proposed exit angle from a wall-ironing ring and an entry angle thereof which is selected between 1 and 4°. This patent also proposes a specific selection of material for the wall-ironing ring.

BACKGROUND OF THE INVENTION

U.S. Pat. No. 3,765,206 proposes the wall ironing of cans from coated steel utilizing a single wall-ironing ring with an entry angle of between 4 and 6°. In this case, the entry angle is understood to mean the angle which the plane of entry to a wall-ironing ring forms with the axis of the said ring. However, this document relates only to steel sheet with a metallic coating.

EP patent application no. 0298560A2 describes a method of wall ironing in two die regions in which in one die region hydrodynamic lubrication under pressure is applied, whereas in the other die region there is no lubrication.

It has been found that various problems may arise with wall ironing for the production of a can from a laminate based on a steel sheet and a layer of plastic. Some of these problems relate to the layer of plastic. During the deep drawing to form a cup, this layer of plastic may begin to form loose strands, may acquire a rough surface or may even rupture entirely. However, problems may also be caused by the fact that the expansion force in the wall-ironing rings is excessive, and this may lead to excess wear to these rings, to dimensional inaccuracy of the product or even to these rings fracturing. In general, the expansion force in a wall-ironing ring will increase as the entry angle selected becomes smaller.

It has been found that using the invention enables these problems to be drastically reduced.

SUMMARY OF THE INVENTION

The invention therefore consists in the fact that, when a sheet metal is used which has been selected from the group comprising steel sheet, tin coated steel sheet (tinplate) and chromium—chromium oxide coated steel sheet (ECCS), the entry angle for each of the successive at least three wall-ironing rings is smaller than that of the preceding ring. It has been found that an entry angle for the first wall-ironing ring should be relatively large in order to prevent the expansion force in this first ring becoming excessive. However, in the following rings the entry angle should become smaller in order to prevent the surface of the layer of plastic from becoming rough.

Good results can be obtained if three wall-ironing rings are used, with the ratio between the entry angles for the first wall-ironing ring and the second wall-ironing ring lying between 1.3 and 3.0 and the ratio between the entry angles for the second wall-ironing ring and the third wall-ironing ring lying between 1.4 and 2.8. Preferably, the said ratios between the entry angles are selected to lie between 1.7 and 2.4, and between 1.7 and 2.3, respectively.

Tests have shown that the optimum entry angle for the first wall-ironing ring is partly dependent on the speed at which the can is formed. This speed is often expressed as the number of can production strokes C per minute. An optimum entry angle for the first wall-ironing ring is then A:C°, where A is selected to be between 560 and 1280 and C represents the number of can production strokes per minute.

During wall ironing, the metal base and the layer of plastic simultaneously undergo considerable deformation. It is important that the layer of plastic continues to form a smooth and continuous surface which adheres well to the metal. Examinations carried out using various plastics in the novel process have shown that after undergoing considerable deformation different plastics may exhibit considerable differences in the extent to which they are crystallized. An indication of the level of crystallization of a polymeric material is obtained by an X-ray diffraction measurement of this plastic. This diffraction measurement measures the extent to which chain molecules of the polymer, or parts of these molecules, are oriented with respect to one another. This measurement technique is generally known and therefore does not require further explanation here. A description of this measurement method is given in "Günther Kämpf; Characterization of Plastics by Physical Methods, Hanser Publishers, page 101". It has been found that it is preferable, in the novel process, to use as the layer of plastic a material which is able to crystallize to a considerable extent as a result of deformation. This reduces the risk of the layer of plastic being damaged or torn off the metal sheet during the wall ironing. In particular, it is preferred to use a plastic of which the maximum crystallinity after wall ironing, as determined by X-ray diffraction measurement, is at least 20%.

In this context, a plastic which has proven eminently suitable is a polyethylene terephthalate with a melting point of higher that 240° C. and an intrinsic viscosity of higher than 0.6, if it is applied to the steel sheet in a layer thickness of between 15 and 30 $\mu$m.

It should be noted that it is possible to determine in the following way whether a layer of plastic crystallizes as a result of deformation sufficiently to be suitable as a coating for the outside of a plastic-coated can as produced in accordance with the novel process.

A layer of amorphous plastic with a thickness of approx. 30 $\mu$m is applied to one side of an ECCS strip, with a suitable thickness of, for example, 0.26 mm, by means of lamination or extrusion coating. The coated strip obtained is used to produce, in two steps, a cup with a diameter of 73 mm, the plastic-coated side forming the outside of the cup. In the first step, a cup with a diameter of 100 mm is deep drawn from a round disc with a diameter of 150 mm. In the second step, this cup is formed into a cup having the final diameter of 73 mm by a further deep-drawing operation. This cup is fed to a wall ironing machine in which the wall thickness of the cup is reduced by wall ironing at a speed of 70 strokes per minute and using a single wall-ironing ring with an entry angle of 8°, which reduces the wall thickness of the cup by at least 40%. A sample is removed from the wall of the cup, whose wall thickness has been reduced by wall ironing, at a level of 50 mm from the base, in order to determine the crystallinity by X-ray diffraction. The crystallinity level found, as described above, must be greater than or equal to 20% in the samples prepared in this way.

Polyethylene terephthalate as mentioned above is understood to mean the polymerization product of a 50—50 mol % mixture of an acid comprising more than 99% terephthalic acid and an alcohol comprising more than 90% ethylene glycol.

BRIEF DESCRIPTION OF THE DRAWINGS

The procedure of the novel process is illustrated in more detail in the appended figures, in which.

DETAILED DESCRIPTIONS OF THE PREFERRED EMBODIMENTS

Figure 1:
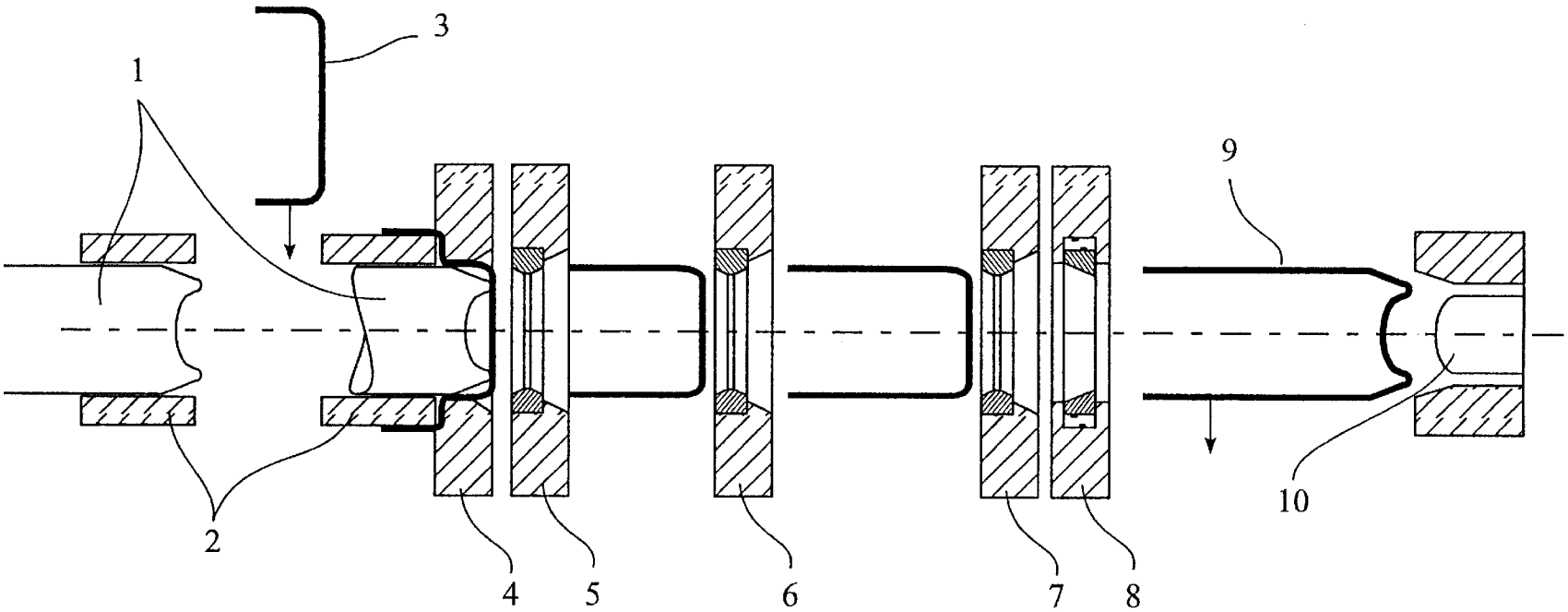
FIG. 1 shows various processing systems in various processing phases.

FIG. 1 illustrates how a preformed deep-drawn cup or beaker 3 is formed into a finished wall-ironed can 9. The cup 3 is placed between a progressive drawing blank holder 2 and a progressive drawing die 4, after which this progressive drawing blank holder 2 and the progressive drawing die 4 are moved towards one another. At the same time, a punch 1 moves to the right, with the result that the cup 3 is brought to an internal diameter of the final finished can 9.

Then, the punch 1 successively forces the product through three wall-ironing rings 5, 6 and 7 and through a stripper ring 8. Wall ironing provides the can 9 to be formed with its ultimate wall thickness and wall length. Finally, the base of can 9 is formed by moving punch 1 towards a base tool 10.

Retracting punch 1 allows the stripper ring 8 to detach can 9 from the punch 1 so that it can be discharged in the transverse direction.

Figure 2:
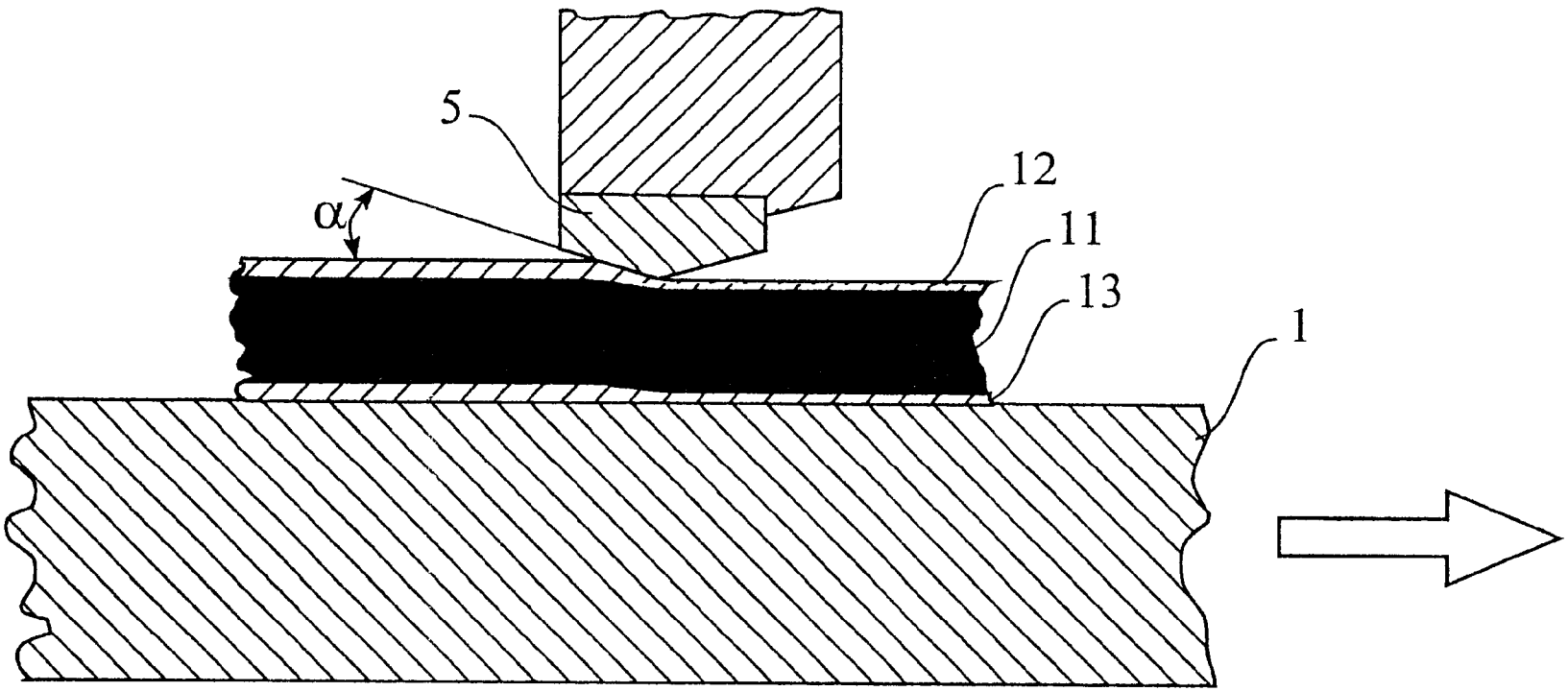
FIG. 2 shows a detail of a wall ironing operation.

FIG. 2 provides a detailed illustration of the passage of a part of the can wall to be formed through, for example, wall-ironing ring 5. Punch 1 is indicated diagrammatically.

The entry plane for wall-ironing ring 5 runs at an entry angle $\alpha$ to the direction of the axis of the wall-ironing ring. The thickness of the material of the wall to be formed is reduced between punch 1 and wall-ironing ring 5. This material comprises the actual metal can wall 11 with layers of plastic 12 and 13 on either side. The figure illustrates how the thickness of all three layers 11, 12 and 13 is reduced.

It has been found that if the entry angles $\alpha$ for the wall-ironing rings 5, 6, and 7 are made to conform with the conditions described above, good results for the surface of the cans 9 formed are obtained without producing impermissibly high expansion forces in the wall-ironing rings. Such good results are obtained, for example, if the entry angles $\alpha$ for the wall-ironing rings 5, 6 and 7 are selected, for example, to be 8°, 4° and 2°, respectively. Selecting the material of the plastic coating as described above results in cans with an intact coating, and the risk of the coating becoming detached from the metal base is negligible.

What is claimed is:

1. Process for the production of a can comprising a base and a tubular body from sheet metal which is coated on at least one side with a layer of plastic, comprising the steps of, producing a round disc from the sheet metal, deep-drawing the disc into a cup which is coated at least on the outside with the layer of plastic, thereafter, forming the cup coated with the layer of plastic into the can by wall ironing, the wall ironing taking place in a single stroke by moving the cup successively through a plurality of wall-ironing rings, wherein the sheet metal is selected from the group consisting of steel sheet and metal coated steel sheet, and wherein an entry angle ($\alpha$) for each of the successive wall-ironing rings is smaller than that of the preceding ring.

2. The process according to claim 1, wherein the sheet metal is selected from the group consisting of steel sheet, tin coated steel sheet (tin plate) and chromium—chromium oxide coated steel sheet (ECCS).

3. The process according to claim 1, wherein the forming step comprises:

successively moving the cup through a first wall-ironing ring and a second wall-ironing ring, wherein the ratio between the entry angles for the first wall-ironing ring and the second wall-ironing ring lies between 1.7 and 2.4; and thereafter moving the cup through a third wall-ironing ring, wherein the ratio between the entry angles for the second wall-ironing ring and the third wall-ironing ring lies between 1.7 and 2.3.

4. The process according to claim 1, wherein the forming step comprises moving the cup through a first wall-ironing ring, the first wall-ironing ring having an entry angle of A: C°, where A is selected to be between 800 and 1280 and C represents the number of can production strokes per minute.

5. The process according to claim 1, wherein the forming step comprises moving the cup through a first wall-ironing ring, the first wall-ironing ring having an entry angle of A: C°, where A is selected to be between 560 and 1280 and C represents the number of can production strokes per minute.

6. The process according to claim 1, wherein the forming step comprises:

successively moving the cup through a first wall-ironing ring and a second wall-ironing ring, wherein the ratio between the entry angles ($\alpha$) for the first wall-ironing ring and the second wall-ironing ring lies between 1.3 and 3.0; and thereafter moving the cup through a third wall-ironing ring, wherein the ratio between the entry angles ($\alpha$) for the second wall-ironing ring (6) and the third wall-ironing ring (7) lies between 1.4 and 2.8.

7. The process according to claim 6, wherein the layer of plastic crystallizes to a considerable extent as a result of deformation of the wall ironing.

8. The process according to claim 7, wherein the crystallizing step comprises crystallizing to a maximum crystallinity after wall ironing, as determined by X-ray diffraction measurement, of at least 20%.

9. The process according to claim 6, wherein the sheet metal is selected from the group consisting of steel sheet, tin coated steel sheet (tin plate) and chromium—chromium oxide coated steel sheet (ECCS).

10. The process according to claim 6, wherein the forming step comprises moving the cup through a first wall-ironing ring, the first wall-ironing ring having an entry angle of A: C°, where A is selected to be between 800 and 1280 and C represents the number of can production strokes per minute.

11. The process according to claim 6, wherein the forming step comprises moving the cup through a first wall-ironing ring, the first wall-ironing ring having an entry angle of A: C°, where A is selected to be between 560 and 1280 and C represents the number of can production strokes per minute.

12. The process according to claim 1, wherein the layer of plastic crystallizes to a considerable extent as a result of deformation of the wall ironing.

13. The process according to claim 12, wherein the plastic comprises a polyethylene terephthalate, with a melting point of greater than 240° C. and an intrinsic viscosity of higher than 0.6, wherein the plastic, is applied to the steel sheet in a layer thickness of between 15 and 30 $\mu$m.

14. The process according to claim 12, wherein the crystallizing step comprises crystallizing to a maximum crystallinity after wall ironing, as determined by X-ray diffraction measurement, of at least 20%.

15. The process according to claim 14, wherein the plastic comprises a polyethylene terephthalate, with a melting point of greater than 240° C. and an intrinsic viscosity of higher than 0.6, wherein the plastic, is applied to the steel sheet in a layer thickness of between 15 and 30 $\mu$m.

* * * * *